US005562170A

United States Patent [19]

Wolfer et al.

[11] Patent Number: 5,562,170

[45] Date of Patent: Oct. 8, 1996

[54] SELF-LUBRICATING, FLUID-ACTUATED, PERCUSSIVE DOWN-THE-HOLE DRILL

[75] Inventors: Dale R. Wolfer, Salem; Leland H. Lyon, Roanoke, both of Va.

[73] Assignee: Ingersoll-Rand Company, Wookcliff Lake, N.J.

[21] Appl. No.: 520,812

[22] Filed: Aug. 30, 1995

[51] Int. Cl.[6] ..... E21B 4/14

[52] U.S. Cl. ..... 175/296; 175/320; 173/208; 173/73

[58] Field of Search ..... 175/100, 215, 175/293, 296, 320; 173/73, 78, DIG. 4, 17, 105, 138, 131, 135, 208

[56] References Cited

U.S. PATENT DOCUMENTS

| | | | |
|---|---|---|---|
| 3,371,730 | 3/1968 | Newman . | |
| 3,606,930 | 9/1971 | Currington . | |
| 5,259,463 | 11/1993 | Bodell et al. | 173/73 |
| 5,299,778 | 4/1994 | Kimberlin | 251/263 |
| 5,307,881 | 5/1994 | Kimberlin | 173/62 |
| 5,325,926 | 7/1994 | Lay et al. . | |
| 5,385,209 | 1/1995 | Bodell et al. | 173/62 |
| 5,402,854 | 4/1995 | Kimberlin et al. | 173/17 |

OTHER PUBLICATIONS

I–R Drilling Equip., Strike Forece 6–OPT–F Downhole Drill, Forms No. PS–5760.56, Sheet 1, Dated May 30, 1987, First Edition.

Parts List For Quantum Leap® Downhole Drill Models: QL6 & QL6QM, Forms PL6076 ©1995 Ingersoll–Rand Company.

*Primary Examiner*—Frank Tsay
*Attorney, Agent, or Firm*—John J. Selko

[57] ABSTRACT

A fluid-actuated, percussive, down-the-hole drill having a piston slidingly supported in a casing and passageways for transmitting flow of percussive fluid to actuate the piston is provided with self-lubricating bearings and self-lubricating seals within the drill to provide a drill requiring no oil lubrication.

10 Claims, 6 Drawing Sheets

SELF-LUBRICATING, FLUID-ACTUATED, PERCUSSIVE DOWN-THE-HOLE DRILL

BACKGROUND OF THE INVENTION

This invention relates generally to downhole pneumatic rock drills (DHD), and more particularly to drills that do not require oil lubrication for sliding surfaces in contact within the drill.

Downhole drills, such as those described by Kurt in U.S. Pat. No. 4,084,646 and by Fu et al in U.S. Pat. No. 5,085,284, are well known in the art. These devices all require the use of special purpose, petroleum oil lubrication to reduce wear of the relatively sliding parts and to prevent friction welding (galling), and subsequent failure of those parts. This lubricant is introduced as a mist in the operating air stream and exhausted into the bore hole (and ultimately the atmosphere) with the air exhausted from the drill. Since the used oil is not recoverable, the operator of the drill must bear considerable expense in providing lubricant for the drill. The open lubrication system may also create environmental problems by introducing oil into the air, ground, and in the some cases, groundwater. This has resulted in DHDs being prohibited in certain applications, groundwater monitoring wells, for example. It is therefore advantageous to produce a DHD which does not require oil lubrication.

DHDs made according to the prior art effect sealing of the operating chambers of the drill by means of a close fit between sliding contact surfaces of the major components of the drill. As normal wear progresses, performance of the drill deteriorates. Ultimately, some or all of the major components of the drill must be replaced to restore drill performance. Unless all worn parts are replaced, performance cannot be restored to new condition. Since the wearing parts are major components of the drill, considerable expense is incurred by such restoration. Due to the close sliding fits required in the prior art, lubrication failure or contamination introduced into the DHD frequently results in catastrophic failure of one or more major components of the drill. Such failure results in lost production, repair expense, and in warranty costs for the manufacturer. It is therefore advantageous to produce a DHD with replaceable seal and bearing elements that prevent catastrophic failure of major drill components and that can restore drill performance following normal wear.

Conventional modern valveless or semi-valveless DHDs typically supply air to the operating chambers via a system of grooves, slots and/or undercuts in the hammer casing ID, piston, or in a "control rod" disposed in the center of the DHD and slidably engaged with the piston. In these DHDs, valving of the air flow is accomplished by the interaction of the termini of these features during the progression of the piston stroke. The grooves, etc. are usually relatively wide to provide adequate flow area for supply air. The termini of these ports are relatively square to precisely define the valving sequence, known in the art as "timing points." If replaceable bearings and seals are introduced to such an arrangement, the seals and bearings will enter the groove or slot. When the seal and/or bearing encounter the terminus of a port, considerable damage to, or catastrophic failure of the seal and bearing element(s) results. It is therefore advantageous that a DHD including replaceable, self-lubricating bearings and seals be provided with a porting arrangement that prevents damage to the bearings and seals.

The foregoing illustrates limitations known to exist in present DHD's. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this alternative is accomplished by providing an improvement to a self-lubricating, fluid-actuated, percussive, down-the-hole drill having a piston slidingly supported in a casing; passageways formed in the drill for transmitting flow of percussive fluid therethrough to actuate the piston; self-lubricating bearing means on an outer surface of the piston for supporting the piston against the casing; and a self-lubricating, floating seal on an outer surface of the piston for selectively opening and closing a portion of the passageways between the piston and the casing during a piston cycle.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
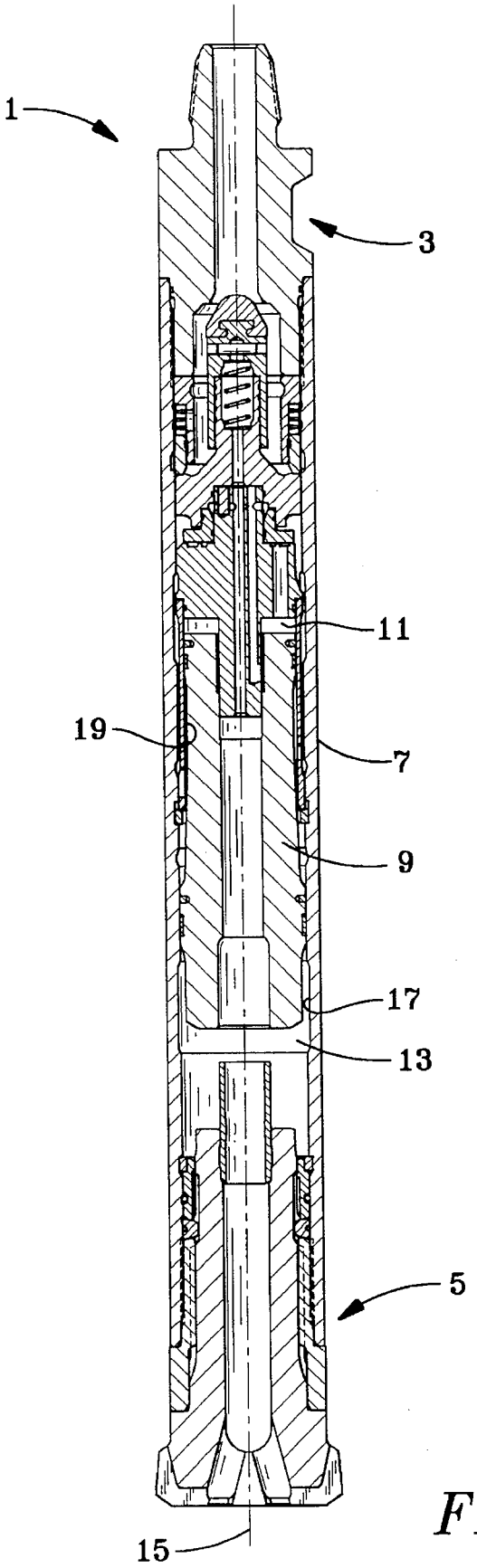
FIG. 1 is a longitudinal section of a downhole drill of the invention.

FIG. 1 shows a self-lubricating, fluid-actuated, percussive, down-the-hole drill 1 having a backhead assembly 3, a fronthead assembly 5, and a hollow, tubular casing 7 connecting backhead assembly 3 and fronthead assembly 5. A piston 9 is slidingly supported in casing 7 for reciprocating between a drive chamber 11 and a return chamber 13. Passageway means are formed in drill 1 for transmitting flow of percussive fluid therethrough to actuate piston 9, as described hereinafter. Backhead assembly 3 and fronthead assembly 5 are aligned with each other along a longitudinal axis 15. Piston 9 is slidingly supported against an inner surface 17 of casing 7 and against an inner surface 19 of backhead assembly 3 for reciprocation between drive chamber 11 and return chamber 13.

Figure 9:
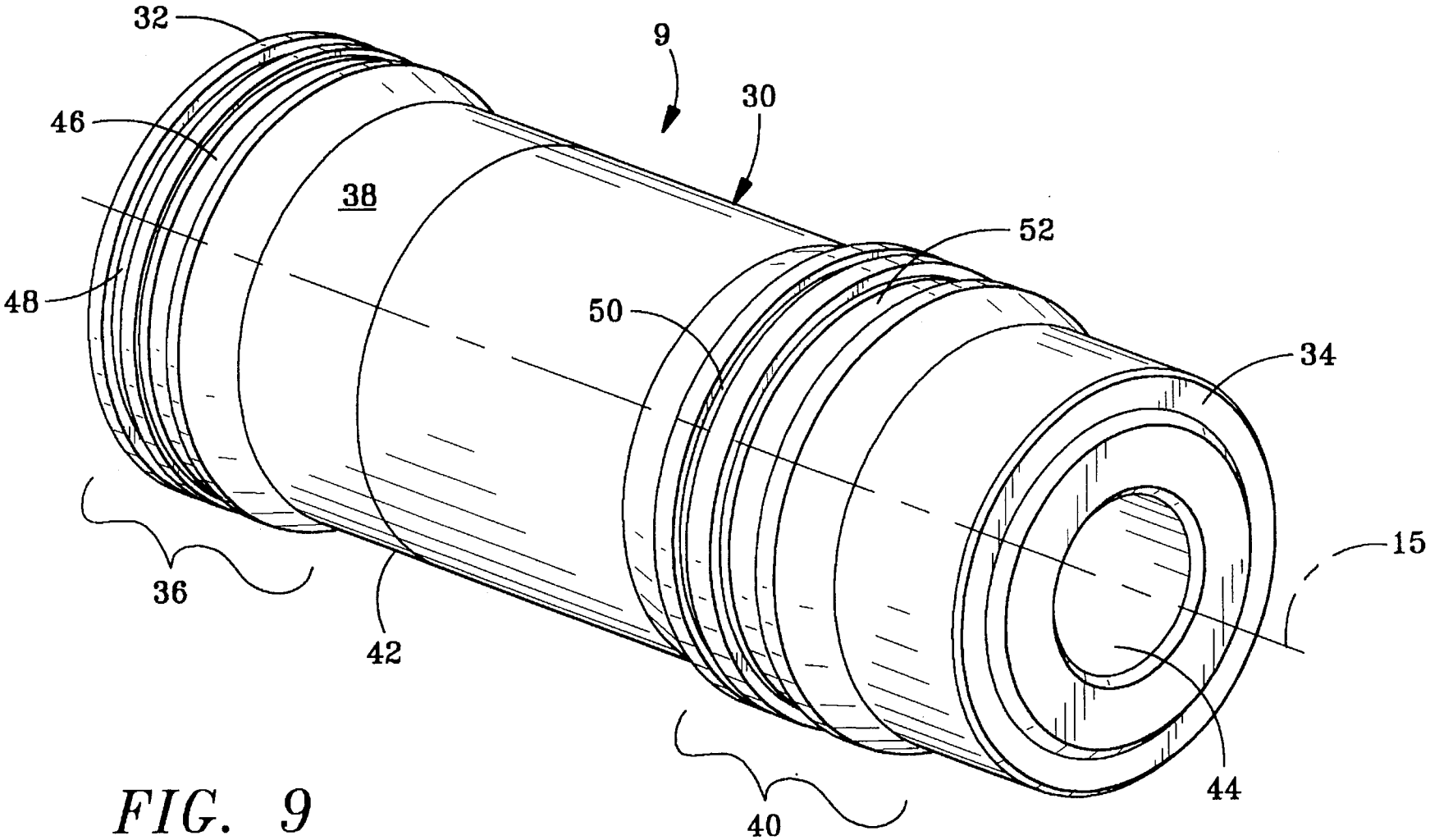
FIG. 9 is an isometric view of a piston according to the invention.

Referring to FIG. 9, the piston 9 will be further described. Piston 9 includes an elongated body member 30 terminating in back end 32 and front end 34. Body member 30 has a generally circular cross section, as viewed radially to longitudinal axis 15. A first land portion 36 is positioned on outer surface 38 adjacent to back end 32. A second land portion 40 is positioned on outer surface 38 adjacent front end 34. An undercut portion 42 extends between first land portion 36 and second land portion 40. Bore 44 extends longitudinally through body member 30 along axis 15. As used herein the term "bore" refers to a bore generally circular in cross section, as viewed perpendicular to axis 15.

First land portion 36 is supplied with annular grooves 46, 48 extending circumferentially around body 30. Second land portion 40 is supplied with annular grooves 50, 52 extending circumferentially around body 30. Grooves 46,48,50, and 52 are parallel to each other and are in planes substantially perpendicular to axis 15. Grooves 46, 50 receive a removable, self-lubricating seal member 54 (FIG.4) and grooves 48, 52 receive a removable, self-lubricating bearing member 56 (FIG. 4), as described hereinafter.

Figure 2:
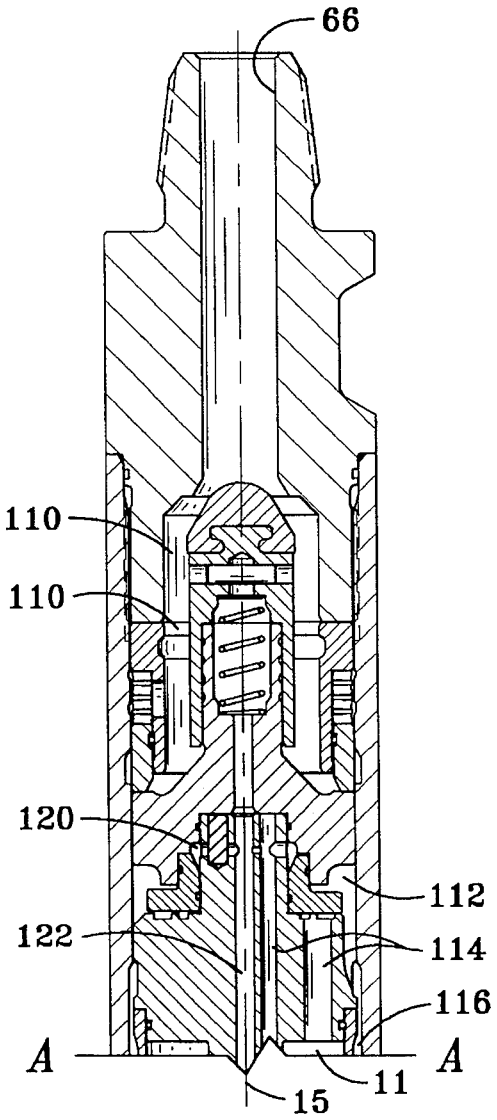
FIG. 2 is longitudinal section of an upper portion of a downhole according to the invention, with the piston in a drive position.
Figure 5:
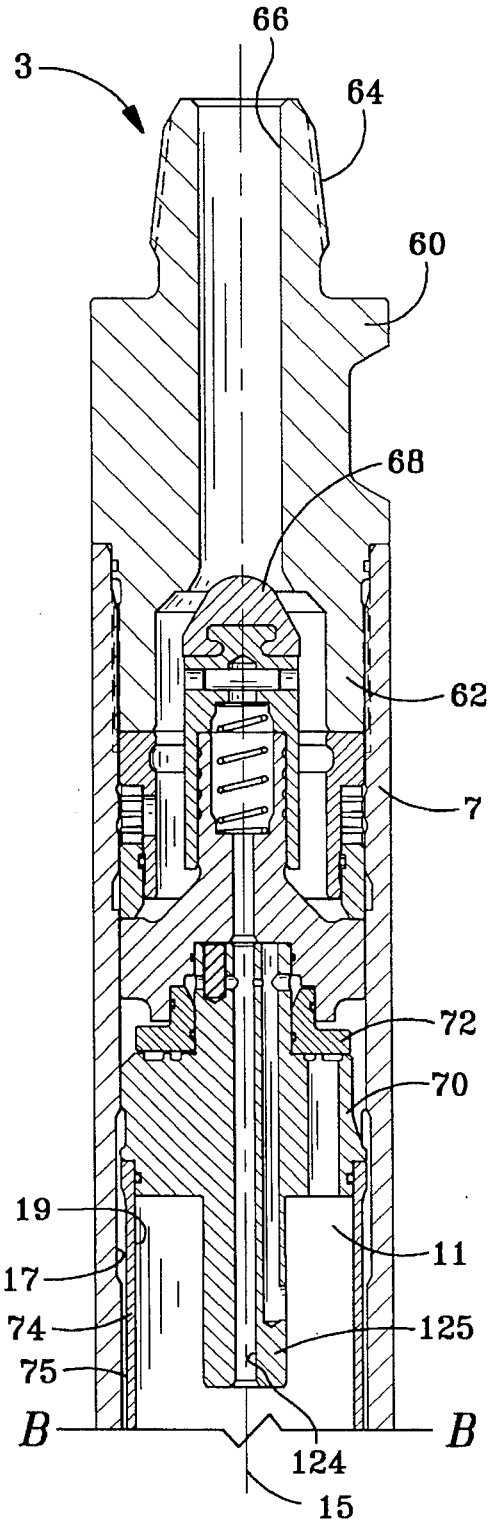
FIG. 5 is a view similar to FIG. 1, with the piston in a position out of contact with the drill bit.
Figure 7:
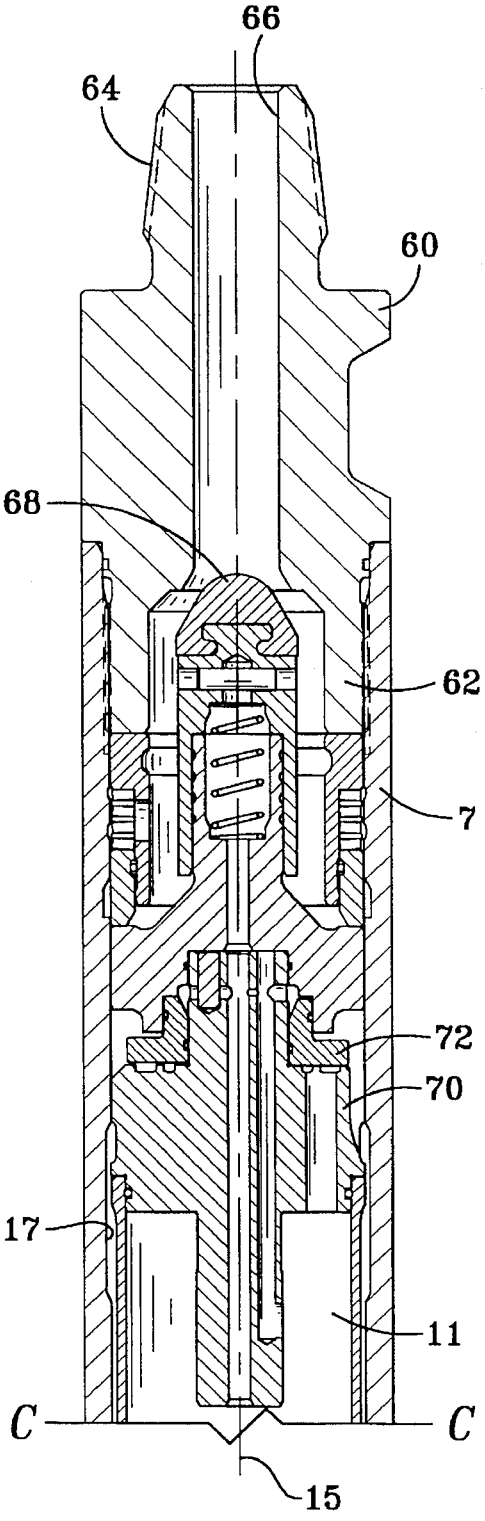
FIG. 7 is a view similar to FIG. 2, with the piston in a return position.

As shown in FIGS. 2,5 and 7, the backhead assembly 3 comprises a backhead member 60 having a first end 62 removably connected to casing 7, and a second end 64 adapted for removably affixing to a drill string (not shown), as is well known. Bore 66 extends longitudinally through backhead assembly along axis 15. Check valve means 68 is positioned in casing 7 for selectively starting and stopping flow of percussive fluid in bore 66, as is well known. Air distributor means 70 is positioned in casing 7 adjacent to check valve means 68. Air distributor means 70 includes a pressure sensitive valve 72 for selectively directing percussive fluid to drive chamber 11 and return chamber 13 during a cycle of piston 9. Valve 72 is of the type described in U.S. Pat. No. 5,301,761 to Chen-Cheng Fu et al. A hollow, tubular cylinder 74 is positioned in casing 7 adjacent air distributor means 70 and supported on stop ring 71. Outer surface 75 of cylinder 74 is spaced from inner surface 17 of casing 7. Air distributor means 70, cylinder 74 and back end 32 of piston 9 are adapted to selectively open and close drive chamber 11 during a cycle of piston 9, as described hereinafter.

Figure 3:
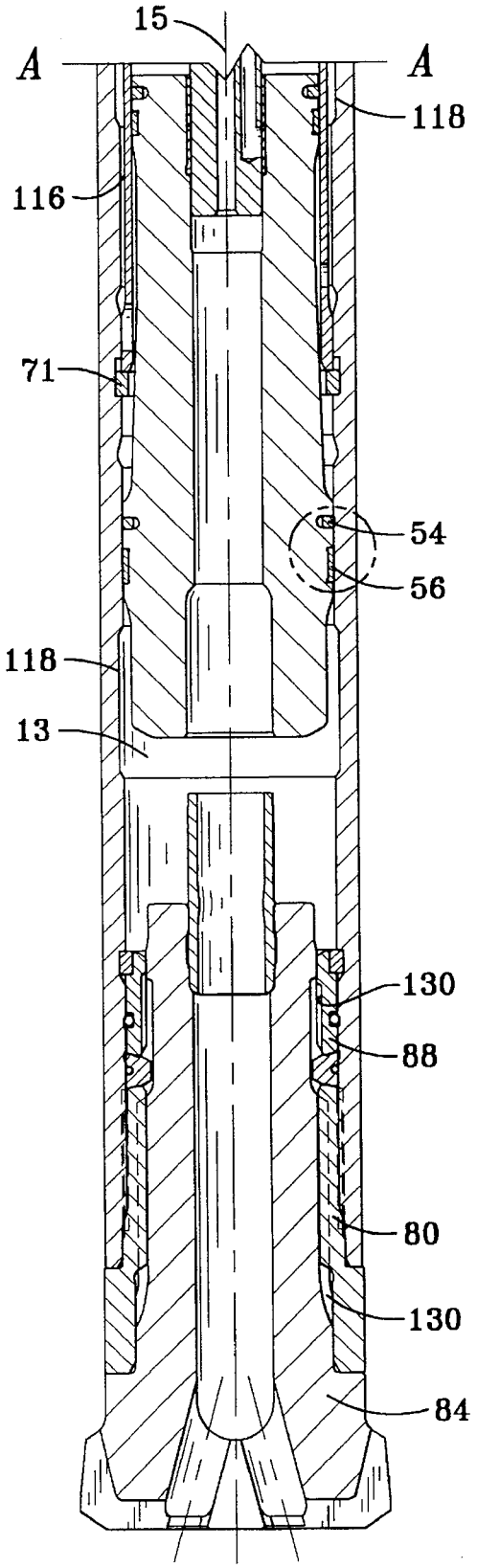
FIG. 3 is longitudinal section of a lower portion of a downhole drill according to the invention, showing the piston in a drive position.
Figure 6:
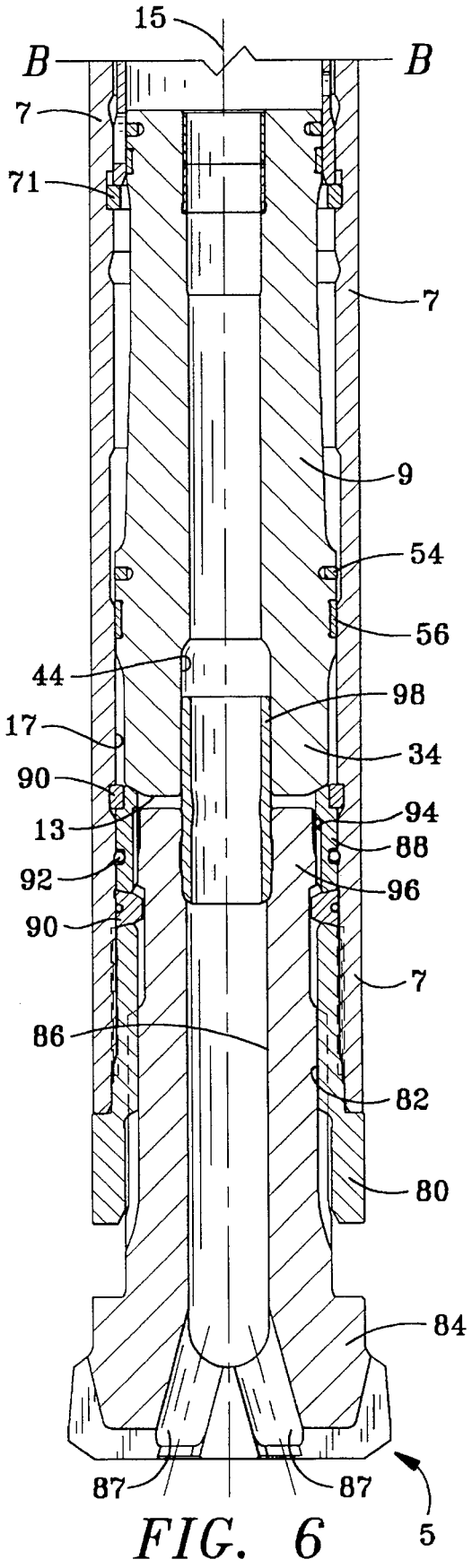
FIG. 6 is a view similar to FIG. 3, showing the piston in a position known as "off bottom"
Figure 8:
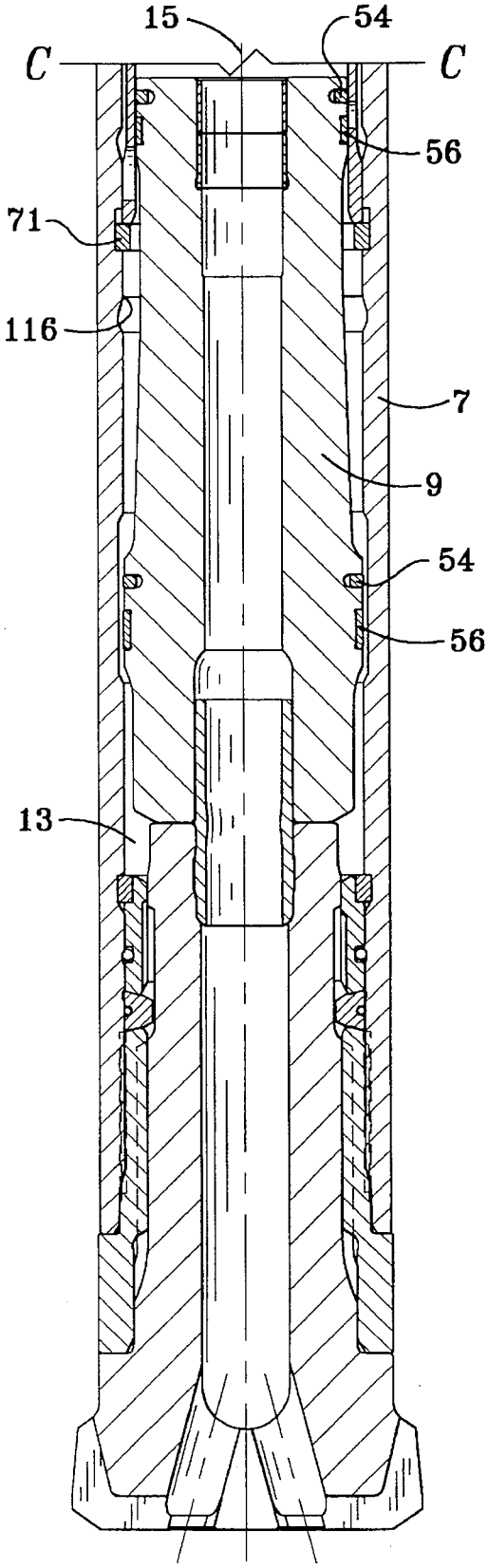
FIG. 8 is a view similar to FIG. 3, showing the piston in a return position.

Referring to FIGS. 3,6 and 8, fronthead assembly 5 will be further described. Fronthead assembly 5 includes chuck 80, removably connected to casing 7, as is will known. Bore 82 extends therethrough along axis 15. Drill bit 84 is removably retained in chuck 80. Bit 84 has bore 86 therethrough along axis 15 and opening into apertures 87. Drill bit bearing 88 is positioned in casing 7 below front end 34 of piston 9 and above chuck 80, using stop ring 90 and retainer 92. Bearing 88 has a bore 94 therethrough along axis 15 for receiving and supporting a back end 96 of bit 84, as is well known. Inner surface 17 of casing 7 and front end 34 of piston 9 are adapted to selectively open and close return chamber 13 during a cycle of piston 9, when piston bore 44 seals and unseals over tube 98 positioned in bit bore 86, as is well known.

Figure 4:
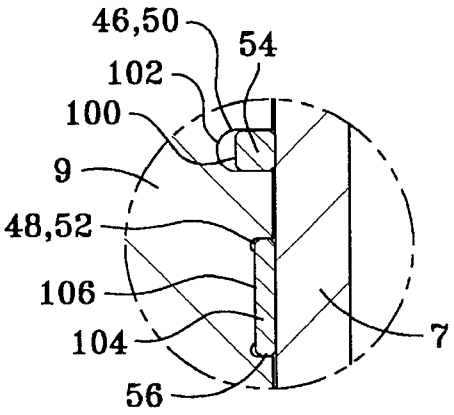
FIG. 4 is an expanded view of the circled portion of FIG. 3.

Now referring to FIG. 4, the self-lubricating seals 54 and bearings 56 will be further described. Seals 54 and bearings 56 are in the form of annular split rings that can be opened to be placed into their respective grooves, 46,50 and 48,52, respectively, on piston 9. Seals 54 are mounted such that the inside diameter 100 of seals 54 does not contact root 102 of grooves 46,50. This arrangement allows seals 54 to "float" in grooves 46,50, thereby maximizing sealing effectiveness. The seals 54 so mounted are energized to "float" by line percussive pressure via communication with passageways in drill 1. The term "float" is used herein to mean that seals 54 have a limited movement in a radial, axial and circumferential direction in grooves 45,50. Since the seal's position is not fixed in relation to piston 9, seals 54 are incapable of performing a load bearing function. Therefore, bearings 56 are positioned near the ends of each land 36,40, adjacent seals 54. Bearings 56 are fit into grooves 48,52 such that there is direct contact between the bearing inside diameter 104 and the bottom 106 of grooves 48,52, as well as between the bearings 56 and oppositely spaced, parallel sidewalls of grooves 48,52. This arrangement prevents substantial movement of bearings 56 radially or axially in grooves 48,52 but permits a slight amount of such movement. In addition, circumferential movement in grooves 48,52 is permitted. Thus, bearings 56 are sufficiently fixed in position to contact their corresponding surface in drill 1 to support piston 9 therein. The grooves 48,52 have a depth such that any bearing therein will not have its outer surface positioned below the outer surface of piston 9.

We have discovered that the sealing function and bearing function cannot be suitably supplied by a single element. A single element designed to "float" in its groove cannot sufficiently guide the piston 9 to maintain alignment. Conversely, a single element fixed in its groove quickly looses its ability to seal effectively due to wear. By separating the sealing and bearing functions, we can provide optimum function in each. We prefer that self-lubricating seals 54 and bearings 56 be made from a monocast nylon material supplied by the Polymer Corporation under the product designation "MC901".

Now referring to FIGS. 2,5 and 7, the backhead passageways will be described. Percussive fluid from drill string (not shown) enters bore 66, passed through accumulator chamber 110, around check valve 68 to air distributor 70 via passageway portion 112. As valve 72 opens and closes, passageway 114 to drive chamber 11 are opened and closed. A casing passageway 116 extends between casing 7 and piston 9 (FIGS. 2,3) to return chamber 13. A portion of the casing passageway 116 is formed by undercuts 118 on the internal surface of casing 7, as described hereinafter.

A longitudinal axis passageway is formed by passageways 120, 122 into bore 124 of air distributor stem 125 extending along axis 15. Bore 124 communicates with bore 44 of piston 9 and bore 86 of bit 84. The longitudinal axis passageway also passes through drive chamber 11 and return chamber 13, when such chambers are uncovered by piston 9.

A fronthead passageway 130 is formed by the combination of inner surface 132 of bit bearing 88 (FIG. 3) and bit 84, when bit 84 is in bearing 88. Fronthead passageway 130 extends along bit 84, in bore 86, between chuck 80 and bit 84.

Figure 10:
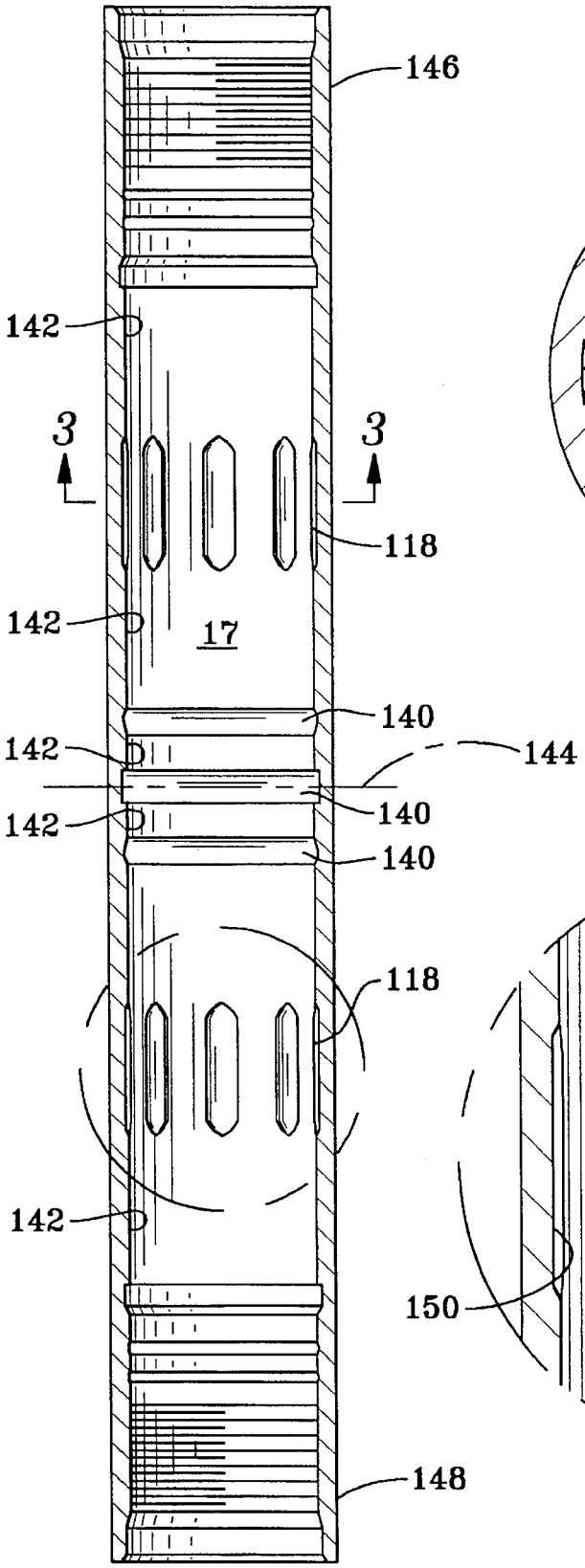
FIG. 10 is a longitudinal section of a casing according to the invention.
Figure 12:
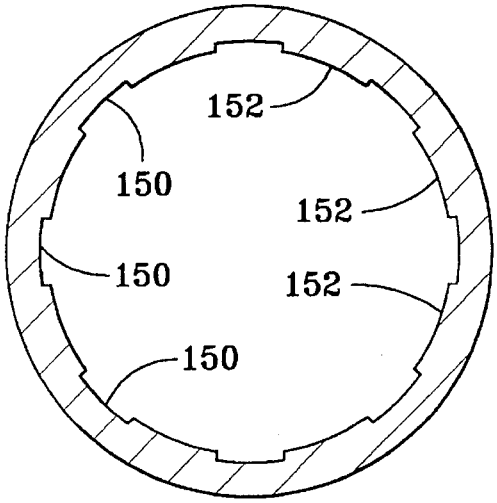
FIG. 12 is a view along 3—3 of FIG. 11.
Figure 11:
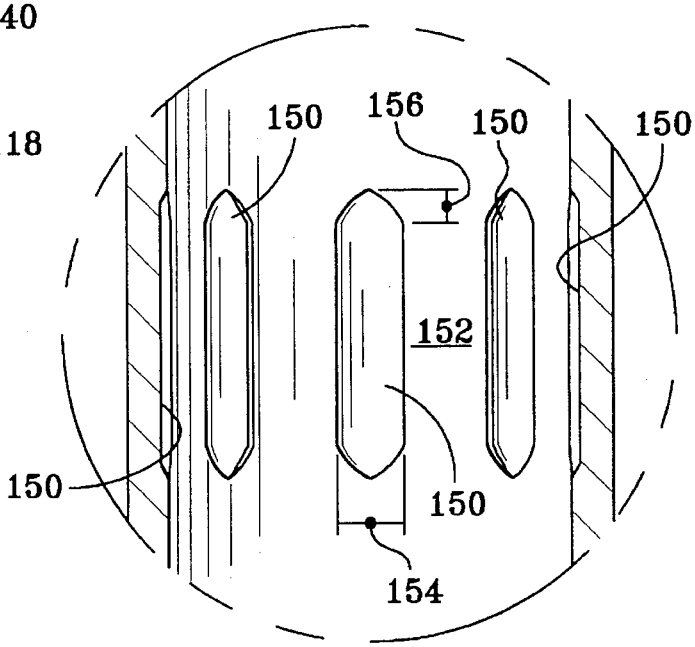
FIG. 11 is an expanded view of the circled portion of FIG. 10.

Now referring to FIGS. 10–12, casing 7 will be further described. Internal surface 17 of casing 7 has a profile that is provided by a plurality of undercut portions 118 and 140 alternating with land portions 142. The profile combines with the surfaces of grooves and undercuts in piston 9, the backhead assembly 3 and the front head assembly 5 to form fluid passageways in drill 1. The exact combination of undercuts 140 and lands 142 in casing 7 and the grooves and undercuts in the other elements may vary from drill to drill, except that the undercuts 118 are required for this invention, as described hereinafter.

A centerline axis 144 is shown perpendicular to longitudinal axis 15. Centerline axis 144 is spaced equally from first and second ends 146,148 of casing 7. We prefer to make casing 7 reversible lengthwise, so that it can be reversed if one end of casing 7 wears during use. In order for casing 7 to be reversible, first undercut and land means (114, 118, 142) between centerline axis 144 and first end 146 must be a substantial mirror image of second undercut and land means (114,118, 142) between centerline axis 144 and second end 148, as measured about centerline axis 144. Slight variations away from mirror image will work, so long as the fluid passageways function the same regardless of lengthwise orientation of the casing 7. Alternately, the casing can be non-reversible by providing non-mirror image relationship between the undercut and land means on either side of centerline axis 144.

Undercuts 118 are required in the fronthead assembly for the self-lubricating seals 54 and bearings 56 described herein. As seen in FIGS. 3,6 and 8, seal 54 and bearing 56 pass over undercut portion 118 during a piston cycle. If undercut 118 were a full annular groove in surface 17, seal 54 and bearing 56 would lose contact with surface 17 during this cycle. However, seal and bearing contact is maintained by providing undercut 118 as an annular "scalloped" portion in casing 7, with one such scalloped portion positioned on either side of centerline axis 144, as shown in FIGS. 10–12. Each scalloped portion, undercut 118, is a plurality of longitudinally extending grooves 150 in surface 17 interrupted by land portions 152 over which seal 54 and bearing 56 ride during the cycle. We have also discovered an unexpected requirement for the dimensions of the grooves 150 to provide optimum performance and long life of seals 54 and bearing 56. Grooves 150 are sized such that the chord length 154 of each groove, measured at the ID of casing 7 is between 2 and 10 percent, and preferably about 5 percent, of the circumference of the bore of casing 7. Further, the sum of the chord lengths 154 of all grooves in a scalloped portion is not more than 50 percent of the bore circumference. Each groove 150 has a first and second end tapered to form a general "V" shape, so as to provide gradual change of contact between grooves 150 and seal 54 and bearing 56. This arrangement minimizes the likelihood that terminal ends of split ring seal 54 and bearing 56 will extend into grooves 150 during the cycle, as a result of the dynamics of motion and pressure in drill 1. The taper length 156 is between 0.2 and 1.5 times chord length 154, preferably about 0.5 times chord length 154.

In use, the sliding surfaces are contacted by the self-lubricating seals 54 and bearings 56, avoiding metal-to-metal contact between major moving parts of the drill 1. The lack of direct contact prevents galling and the resultant damage to major drill parts. The self-lubricating properties of the seal and bearing material fulfills the low friction requirement for proper drill operation. The need for fluid lubrication is minimized or eliminated. The injection of a small amount (½ to 1-½ gallons per minute) of water into the fluid stream is preferred for cooling the drill.

As seals 54 wear, pressure energization maintains effective sealing contact between the seal 54 and its cooperating part. If seals 54 and/or bearings 56 wear to the extent that drill performance is deteriorated, the worn parts are simply replaced, without the need for special tools or fixtures. Since essentially all of the wear occurs on the seals 54 and bearings 56, the drill is returned to "new" performance levels when these components are replaced.

Several alternate embodiments of the inventions herein may be considered without departing from them:

(1) Self lubricating elements can be added to the bore 44 of piston 9 and, or air distributor stem 125.

(2) Seals 54 and bearing 56 can be installed in inner surface 17 of casing 7 and/or inner surface 19 of cylinder 74.

(3) Anywhere bearings and seals slide against land areas, self-lubricating members as described herein can be installed.

What is claimed is:

1. In a self-lubricating, fluid-actuated, percussive, down-the-hole drill having a backhead assembly; a fronthead assembly; a casing connecting said backhead assembly and said fronthead assembly; a piston in said casing slidingly supported in said casing for reciprocating between a drive chamber and a return chamber; passageway means formed in said drill for transmitting flow of percussive fluid therethrough to actuate said piston; the improvement comprising:

(a) self-lubricating bearing means in said drill for supporting an outer surface of said piston against said casing; and against said backhead assembly; and (b) self-lubricating, floating seal means in said drill for sealing an outer surface of said piston against said casing and against said backhead assembly, for selectively opening and closing a portion of said passageway means during a piston cycle.

2. A self-lubricating, fluid-actuated, percussive, down-the-hole drill comprising:

(a) a backhead assembly;

(b) a fronthead assembly aligned with said backhead assembly along a longitudinal axis;

(c) a hollow, tubular, casing connecting said backhead assembly and said fronthead assembly;

(d) a piston slidingly supported against an inner surface of said casing and against an inner surface of said backhead assembly, for reciprocating between a drive chamber and a return chamber;

(e) passageway means formed in said drill, for transmitting percussive fluid therethrough to actuate said piston;

(f) self-lubricating bearing means on an outer surface of said piston for supporting said piston against said casing and against said backhead assembly; and (g) self-lubricating, floating seal means on an outer surface of said piston for contacting said casing and said backhead assembly to selectively open and close a portion of said passageway means during a piston cycle.

3. The down-the-hole drill of claim 2 wherein said piston comprises:

(a) an elongated body member terminating in a back end and a front end, said body member having a generally circular cross section, as viewed radially to said longitudinal axis;

(b) a first land portion on an outer surface of said body member adjacent to said back end;

(c) a second land portion on said outer surface of said body member adjacent to said front end;

(d) an undercut body portion on said outer surface of said body member between said first and second land portions; and (e) a bore through said body member along said axis.

4. The down-the-hole drill of claim 3 wherein said backhead assembly comprises:

(a) a backhead member having one end removably connected to said casing, and a second end adapted for removably affixing to a drill string, said backhead member having a bore therethrough along said axis;

(b) check valve means in said casing for selectively starting and stopping flow of percussive fluid in said bore;

(c) air distributor means in said casing adjacent to said check valve means for selectively directing said percussive fluid to said drive chamber and to said return chamber during a piston cycle;

(d) a hollow, tubular cylinder in said casing adjacent said air distributor means, said cylinder being spaced from said inner surface of said casing; and (e) said air distributor means, said cylinder and said back end of said piston being adapted to selectively open and close said drive chamber during a piston cycle.

5. The down-the-hole drill of claim 4 wherein said fronthead assembly comprises:

(a) chuck means in said casing, removably connected to said casing, said chuck means having a bore therethrough along said axis for receiving and retaining a drill bit;

(b) bearing means in said casing, between said front end of said piston and said chuck means, said bearing means having a bore therethrough along said axis for receiving and supporting a back end of a drill bit; and (c) said inner surface of said casing and said front end of said piston being adapted to selectively open and close said return chamber during a piston cycle.

6. The down-the hole-drill of claim 5 wherein said passageway means comprises:

(a) backhead passageway means for transmitting percussive fluid;

(b) fronthead passageway means for transmitting percussive fluid;

(c) a longitudinal axis passageway means for transmitting percussive fluid; and (d) a casing passageway means for transmitting percussive fluid.

7. The down-the hole-drill of claim 6 wherein said backhead passageway means comprises:

(a) an accumulator chamber in said backhead member bore;

(b) a first passageway portion from said accumulator chamber and around said check valve means;

(c) a second passageway portion through said air distributor means;

(d) a third passageway portion between said inner surface of said casing and a portion of said air distributor means; and (e) a fourth passageway portion between said inner surface of said casing and said cylinder.

8. The down-the hole-drill of claim 7 wherein said fronthead passageway means comprises:

(a) a fifth passageway portion between an inner surface of said bearing means and a drill bit when it is received by said bearing means; and (b) a sixth passageway portion between said inner surface of said chuck means and a drill bit when it is received by said front head assembly.

9. The down-the-hole drill of claim 8 wherein said longitudinal axis passageway comprises a seventh passageway portion connecting said drive chamber, said bore through said piston, said return chamber and a bore through said drill bit.

10. The down-the-hole drill of claim 9 wherein said casing passageway means comprises:

(a) an eighth passageway portion between said inner surface of said casing and said piston body; and (b) a ninth passageway portion between a scalloped undercut portion of said inner surface of said casing and said second land on said piston.

* * * * *